US010203648B2

(12) United States Patent
Takeyama et al.

(10) Patent No.: US 10,203,648 B2
(45) Date of Patent: Feb. 12, 2019

(54) CLEANING BLADE FOR ELECTROPHOTOGRAPHIC EQUIPMENT

(71) Applicant: Sumitomo Riko Company Limited, Aichi (JP)

(72) Inventors: Kadai Takeyama, Aichi (JP); Masanori Ishida, Aichi (JP); Toshihiko Arata, Aichi (JP); Shimpei Miyagawa, Aichi (JP)

(73) Assignee: Sumitomo Riko Company Limited, Aichi (JP)

( * ) Notice: Subject to any disclaimer, the term of this patent is extended or adjusted under 35 U.S.C. 154(b) by 0 days.

(21) Appl. No.: 16/016,688

(22) Filed: Jun. 25, 2018

(65) Prior Publication Data

US 2018/0307178 A1 Oct. 25, 2018

Related U.S. Application Data

(63) Continuation of application No. PCT/JP2017/019588, filed on May 25, 2017.

(30) Foreign Application Priority Data

Jun. 30, 2016 (JP) ..... 2016-129502

(51) Int. Cl.
*G03G 21/00* (2006.01)

(52) U.S. Cl.
CPC . *G03G 21/0017* (2013.01); *G03G 2221/0089* (2013.01); *G03G 2221/1606* (2013.01)

(58) Field of Classification Search
CPC ..... G03G 21/0017; G03G 2221/1606; G03G 2221/0089
See application file for complete search history.

(56) References Cited

U.S. PATENT DOCUMENTS 4,552,944 A * 11/1985 Kamiyama ..... C08G 18/222 528/55
5,157,098 A * 10/1992 Lindblad ..... C08G 18/10 399/351

(Continued)

FOREIGN PATENT DOCUMENTS

JP 2007133075 5/2007
JP 5506606 5/2014

(Continued)

OTHER PUBLICATIONS

"International Search Report (Form PCT/ISA/210)" of PCT/JP2017/019588, dated Jun. 20, 2017, with English translation thereof, pp. 1-2.

*Primary Examiner* — Francis C Gray
(74) *Attorney, Agent, or Firm* — JCIPRNET

(57) ABSTRACT

The disclosure shows a cleaning blade for electrophotographic equipment, the cleaning blade through which both high hardness and low warping are obtained and excellent toner scraping properties are realized. The cleaning blade (10) includes a blade part (12) comprising a cured material of a urethane composition containing a polyol, an isocyanate, and a crosslinker or a chain extender. The content of the isocyanate is 28.0 mass % or more with respect to the entire composition. The crosslinker or the chain extender comprises a triol having a molecular weight of 150 or less. The content of the crosslinker or the chain extender is 4.0 mass % or less with respect to the entire composition. The content of the triol having a molecular weight of 150 or less is 0.8 mass % or more with respect to the entire composition.

12 Claims, 2 Drawing Sheets

(56) References Cited

U.S. PATENT DOCUMENTS

| | | | | |
|---|---|---|---|---|
| 5,656,720 | A * | 8/1997 | Schlueter, Jr. | C08G 18/10 528/60 |
| 2006/0229425 | A1* | 10/2006 | Inoue | C08G 18/10 528/44 |
| 2008/0312386 | A1* | 12/2008 | Nakamura | C08G 18/10 525/457 |
| 2009/0003905 | A1* | 1/2009 | Ueno | G03G 21/0017 399/350 |
| 2009/0290921 | A1* | 11/2009 | Mochizuki | G03G 21/0017 399/350 |
| 2015/0177674 | A1* | 6/2015 | Tano | G03G 21/0017 399/350 |
| 2016/0187814 | A1 | 6/2016 | Nakamura et al. | |

FOREIGN PATENT DOCUMENTS

| | | |
|---|---|---|
| JP | 5797439 | 10/2015 |
| JP | 2016126123 | 7/2016 |

* cited by examiner

CLEANING BLADE FOR ELECTROPHOTOGRAPHIC EQUIPMENT

CROSS REFERENCE TO RELATED APPLICATION

This application is a Continuation of PCT International Application No. PCT/JP2017/019588, filed on May 25, 2017, which claims priority under 35 U.S.C § 119(a) to Patent Application No. 2016-129502, filed in Japan on Jun. 30, 2016, all of which are hereby expressly incorporated by reference into the present application.

BACKGROUND

Technical Field

The disclosure relates to a cleaning blade for electrophotographic equipment.

Related Art

In electrophotographic equipment such as a copying machine, a printer, and a facsimile using an electrophotographic method, a cleaning blade for removing toner that remains on an outer circumferential surface of a photosensitive drum is provided.

In the cleaning blade, a blade part in contact with the outer circumferential surface of the photosensitive drum is formed of a urethane composition. A tip part of the blade part slides on the outer circumferential surface of the photosensitive drum that rotates, and thereby the toner that remains on the outer circumferential surface of the photosensitive drum is removed.

For a cleaning blade in the related art, in a urethane composition, setting a high NCO index, adjusting a hydroxyl value of a curing agent and mixing in a quaternary ammonium salt in a predetermined amount, thereby obtaining both wear resistance and low temperature properties has been proposed (Japanese Patent No. 5506606, hereinafter Patent Literature 1). In addition, in a urethane composition, including a specific polyester polyol, 1,4-butanediol (BD), trimethylolpropane (TMP), and diphenylmethane diisocyanate, and adjusting crosslinking molecular weights by setting the BD and the TMP to predetermined proportions, thereby obtaining both wear resistance and low temperature properties has been proposed (Japanese Patent No. 5797439, hereinafter Patent Literature 2). In addition, in a urethane composition, including a specific polyoxytetramethylene glycol, a polyisocyanate, 1,4-butanediol (BD) and trimethylolpropane (TMP), and setting predetermined proportions of BD and TMP, thereby obtaining both wear resistance and low temperature properties has been proposed (Japanese Laid-open No. 2007-133075, hereinafter Patent Literature 3).

CITATION LIST

Patent Literature

[Patent Literature 1] Japanese Patent No. 5506606

[Patent Literature 2] Japanese Patent No. 5797439

[Patent Literature 3] Japanese Laid-open No. 2007-133075

Both initial toner scraping properties and toner scraping properties after severe use are necessary for a cleaning blade. In order that there are adequate initial toner scraping properties, high hardness is required. However, generally, the higher the hardness, the greater the tendency to become fragile and warped. Then, toner slip-through after severe use occurs and toner scraping properties after severe use deteriorate. In order that there are adequate toner scraping properties after severe use, both high hardness and low warping are required. The related art failed to obtain cleaning blades that having both high hardness and low warping. In all of Patent Literature 1 to 3, both wear resistance and low temperature properties are obtained, but there is no description that both high hardness and low warping are obtained. In the case of Patent Literature 2 and 3, the rubber hardness is low, and initial toner scraping properties are not adequate.

SUMMARY

The disclosure provides a cleaning blade for electrophotographic equipment through which both high hardness and low warping are obtained and excellent toner scraping properties are realized.

A cleaning blade for electrophotographic equipment according to the disclosure includes a blade part comprising a cured material of a urethane composition containing a polyol, an isocyanate, and a crosslinker or a chain extender, wherein a content of the isocyanate is 28.0 mass % or more with respect to the entire composition, wherein the crosslinker or the chain extender comprises a triol having a molecular weight of 150 or less, wherein a content of the crosslinker or the chain extender is 4.0 mass % or less with respect to the entire composition, and wherein a content of the triol having a molecular weight of 150 or less is 0.8 mass % or more with respect to the entire composition.

The crosslinker or the chain extender may further comprise a diol having a molecular weight of 150 or less. In addition, the crosslinker or the chain extender may comprise the triol having a molecular weight of 150 or less and may contain no diol. The triol having a molecular weight of 150 or less is preferably trimethylolpropane. The diol having a molecular weight of 150 or less is preferably 1,4-butanediol. The content of the triol having a molecular weight of 150 or less is preferably 2.0 mass % or more with respect to the entire composition.

According to the cleaning blade for electrophotographic equipment of the disclosure, it is possible to obtain both high hardness and low warping, and realize excellent toner scraping properties.

DESCRIPTION OF EMBODIMENTS

Figure 1:
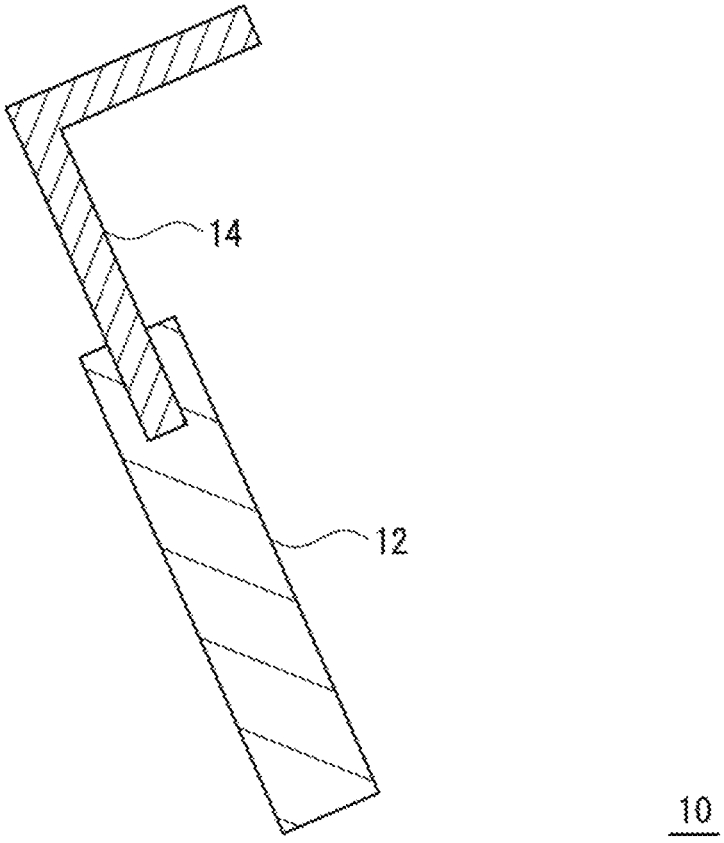
FIG. 1 is a cross-sectional view of a cleaning blade for electrophotographic equipment according to an embodiment of the disclosure.

Embodiments of the disclosure will be described below in detail with reference to the drawings. FIG. 1 is a cross-sectional view showing a cleaning blade for electrophotographic equipment (hereinafter referred to as the present blade) according to an embodiment of the disclosure. FIG.

2 is a schematic view showing a state in which a cleaning blade slides on an outer circumferential surface of a photosensitive drum.

Figure 2:
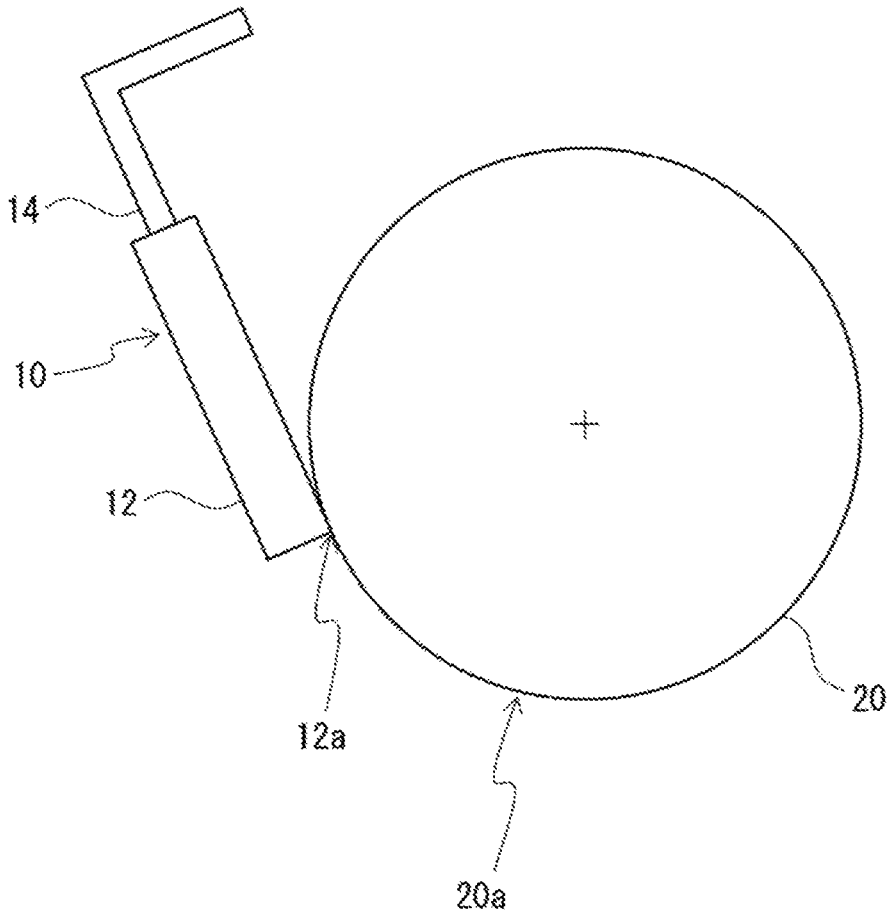
FIG. 2 is a schematic view showing a state in which a cleaning blade for electrophotographic equipment according to an embodiment of the disclosure slides on an outer circumferential surface of a photosensitive drum that rotates.

As shown in FIG. 1, a cleaning blade (the present blade) 10 for electrophotographic equipment according to an embodiment of the disclosure includes a blade part 12. A holding part 14 that holds the blade part 12 is attached to the blade part 12. The blade part 12 comprises a cured material of a urethane composition and is formed by molding the urethane composition into a predetermined shape. The blade part 12 has a flat plate shape. The holding part 14 comprises a metal fitting having an L-shaped cross section. As shown in FIG. 2, the blade part 12 has a tip part 12*a* that comes in contact with an outer circumferential surface 20*a* of a photosensitive drum 20 and slides on the outer circumferential surface 20*a* of the photosensitive drum 20 that rotates. Thereby, toner that remains on the outer circumferential surface 20*a* of the photosensitive drum 20 is removed.

The urethane composition contains a polyol, an isocyanate, and a crosslinker or a chain extender. The crosslinker or the chain extender comprises a triol having a molecular weight of 150 or less. The crosslinker or the chain extender may further comprise a diol having a molecular weight of 150 or less. In addition, the crosslinker or the chain extender may comprise the triol having a molecular weight of 150 or less and may contain no diol.

A urethane composition according to a first embodiment contains a polyol, an isocyanate, and a crosslinker or a chain extender, and the crosslinker or the chain extender comprises a triol having a molecular weight of 150 or less and contains no diol.

The polyol is a polyol for urethane, and examples thereof include a polyester polyol, a polyether polyol, a polycaprolactone polyol, and a polycarbonate polyol. These polyols may be used alone or two or more thereof may be used in combination. Among them, a polyester polyol is more preferable from a viewpoint of excellent mechanical strength or the like.

The polyester polyol is obtained from a polybasic organic acid and a short chain polyol, and a polyester polyol having a hydroxyl group as an end group is preferable. The polybasic organic acid is not particularly limited, and examples thereof include a dicarboxylic acid, for example, a saturated fatty acid such as oxalic acid, succinic acid, glutaric acid, adipic acid, pimelic acid, suberic acid, azelaic acid, sebacic acid, and isosebacic acid, an unsaturated fatty acid such as maleic acid and fumaric acid, and an aromatic acid such as phthalic acid, isophthalic acid, and terephthalic acid, an acid anhydride such as maleic anhydride and phthalic anhydride, a dialkyl ester such as dimethyl terephthalate, and a dimer acid obtained by dimerization of an unsaturated fatty acid. The short chain polyol is not particularly limited, and, for example, a diol such as ethylene glycol, diethylene glycol, triethylene glycol, propylene glycol, dipropylene glycol, butylene glycol, neopentyl glycol, and 1,6-hexylene glycol, a triol such as trimethylolethane, trimethylolpropane, hexanetriol, and glycerin, and a hexaol such as sorbitol may be exemplified.

As the polyester polyol, specifically, polyethylene adipate (PEA), polybutylene adipate (PBA), polyhexylene adipate (PHA), and a copolymer (PEA/BA) of ethylene adipate and butylene adipate are more preferable. These may be used alone or two or more thereof may be used in combination. Among them, polybutylene adipate (PBA) is particularly preferable from a viewpoint of improving wear resistance and improving durability.

As the polyether polyol, a polyether polyol obtained by ring-opening polymerization or copolymerization of a cyclic ether is preferable. As the cyclic ether, for example, ethylene oxide, propylene oxide, trimethylene oxide, butylene oxide, α-methyltrimethylene oxide, 3,3'-dimethyltrimethylene oxide, tetrahydrofuran, dioxane, and dioxamine may be exemplified. As the polyether polyol, specifically, polyoxytetramethylene glycol, and polyoxypropylene glycol may be exemplified.

A number average molecular weight of the polyol is within a range of preferably 1,000 to 3,500 and more preferably 1,500 to 2,500. When the number average molecular weight is 1,000 or more, it is possible to prevent deterioration in physical properties of the obtained urethane rubber. In addition, when the number average molecular weight is 3,500 or less, an increase in viscosity of a prepolymer can be prevented and moldability can be improved.

The isocyanate is an isocyanate for urethane, and examples thereof include 4,4'-diphenylmethane diisocyanate (MDI), isophorone diisocyanate (IPDI), 4,4'-dicyclohexylmethane diisocyanate (hydrogenated MDI), trimethylhexamethylene diisocyanate (TMHDI), tolylene diisocyanate (TDI), a carbodiimide modified MDI, polymethylene phenyl isocyanate (PAPI), orthotoluidine diisocyanate (TODD, naphthylene diisocyanate (NDI), xylene diisocyanate (XDI), hexamethylene diisocyanate (HMDI), paraphenylene diisocyanate (PDI), lysine diisocyanate methyl ester (LDI), and dimethyl diisocyanate (DDI). These may be used alone or two or more thereof may be used in combination. Among them, in consideration of improvement in wear resistance, ease of handling, availability, cost and the like, 4,4'-diphenylmethane diisocyanate (MDI) is particularly preferable.

As the isocyanate, an NCO-terminated urethane prepolymer obtained by reacting the above isocyanates such as MDI with the polyol may be used. Since the urethane prepolymer is terminated with an NCO group, NCO % is preferably within a range of 5 to 30 mass %. NCO % is calculated by the following formula.

$$\{[(\text{weight of polyisocyanate/equivalent of polyisocyanate})-(\text{weight of polyol/equivalent of polyl})\times 42.02]/(\text{weight of polyisocyanate}+\text{weight of polyol})\}\times 100 \quad \text{[Math. 1]}$$

A content of the isocyanate is 28.0 mass % or more with respect to the entire composition. When a content of the isocyanate is relatively increased, the hardness of urethane can be increased and initial toner scraping properties can be improved. When the content is less than 28.0 mass %, initial toner scraping properties are not adequate. In addition, in this regard, a content of the isocyanate is preferably 29.0 mass % or more, and more preferably 30.0 mass % or more with respect to the entire composition. On the other hand, in consideration of moldability and the like, a content of the isocyanate is preferably 40 mass % or less and more preferably 35 mass % or less with respect to the entire composition. In addition, in order to improve the initial toner scraping properties (improve the hardness of urethane) and the like, an NCO index (isocyanate index) is preferably 170 or more, more preferably 180 or more, and most preferably 200 or more. In addition, in consideration of moldability and the like, the NCO index is preferably 400 or less, more preferably 350 or less, and most preferably 300 or less. The NCO index is calculated as an equivalent of isocyanate groups with respect to the total equivalent of 100 of active hydrogen groups (such as a hydroxyl group and an amino group) that react with an isocyanate group.

When a content of the isocyanate is relatively large, a linear polyurethane has a higher amount of aggregation in hard segments comprising a urethane bond (polar group), and becomes hard, and is likely to become fragile and warped. When a crosslinker or a chain extender is added thereto, it becomes harder. However, since the crosslinker or the chain extender is a triol and is trifunctional, an effect of preventing crystallization according to crosslinking is exhibited, and thus it is possible to prevent warping (reduce warping).

A content of a triol of the crosslinker or the chain extender is 0.8 mass % or more with respect to the entire composition. Therefore, even if a content of the isocyanate is relatively large, it is possible to prevent warping while high hardness is maintained and toner scraping properties after severe use are adequate while the initial toner scraping properties are maintained. In this regard, a content of a triol of the crosslinker or the chain extender is preferably 1.0 mass % or more, and more preferably 1.5 mass % or more with respect to the entire composition.

On the other hand, when a content of a triol of the crosslinker or the chain extender is excessively large, this triol part is also a hard segment, hard segments including the triol are likely to aggregate and crystallize, and warping is likely to occur. Therefore, a content of a triol of the crosslinker or the chain extender is 4.0 mass % or less with respect to the entire composition. Therefore, aggregation and crystallization of hard segments including the triol are prevented and thereby it is possible to prevent warping (reduce warping). In this regard, a content of a triol of the crosslinker or the chain extender is preferably 3.5 mass % or less and more preferably 3.0 mass % or less with respect to the entire composition.

As a triol of the crosslinker or the chain extender, a relatively short chain trial (having a molecular weight of 150 or less) is used. As such a triol, trimethylolpropane (TMP), glycerin, 1,2,6-hexanetriol, trimethylolethane, 1,2,4-butanetriol, 1,2,3-pentanetriol, 2,3,4-pentanetriol, 1,3,4-pentanetriol, 1,2,5-pentanetriol, 1,2,4-pentanetriol, 2-(hydroxymethyl)-1,3-butanediol, 2-(hydroxymethyl)-1,4-butanediol, 3-methyl-1,2,3-butanetriol, 2-ethyl-1,2,3-propanetriol, and 2-methyl-1,2,4-butanetriol may be exemplified. These may be used alone or two or more thereof may be used in combination. Among these, trimethylolpropane is particularly preferable from a viewpoint of a strong effect of preventing crystallization or the like.

The urethane composition according to the first embodiment may contain other components in addition to the polyol, the isocyanate, and the crosslinker or the chain extender as long as there is no influence on the disclosure. The other components may include a curing catalyst, a surfactant, a flame retardant, a coloring agent, a filler, a plasticizer, a stabilizer, and a mold release agent.

The curing catalyst is a catalyst that promotes a urethanization reaction. As the curing catalyst, amine compounds such as triethylenediamine (TEDA), a tertiary amine, a diazabicyclo amine, and a salt of a diazabicyclo amine, a quaternary ammonium salt, an isocyanuration catalyst, and an organometallic compound can be exemplified. These may be used alone or may be used in combination.

As the tertiary amine, a trialkylamine such as triethylamine, a tetraalkyldiamine such as N,N,N,N-tetramethyl-1,3-butanediamine, an amino alcohol such as dimethylethanolamine, an ester amine such as a bis(diethylethanolamine) adipate, morpholine derivatives, and piperazine derivatives can be exemplified.

As the diazabicyclo amine, 1,8-diazabicyclo(5.4.0)-undecene-7 (DBU), and 1,5-diazabicyclo(4.3.0)-nonene-5 (DBN) can be exemplified.

As the organometallic compound, an organic tin compound such as dibutyltin laurate, dibutyltin di(2-ethyl hexoate), stannous 2-ethylcaproate, and stannous oleate, and a non-tin organometallic compound such as potassium octoate, potassium acetate, bismuth carboxylate, and a zirconium complex can be exemplified.

A content of the curing catalyst is within a range of preferably 0.002 to 0.02 parts by mass and more preferably 0.005 to 0.015 parts by mass with respect to 100 parts by mass of the curing agent.

A urethane composition according to a second embodiment contains a polyol, an isocyanate, and a crosslinker or a chain extender, and the crosslinker or the chain extender comprises a diol having a molecular weight of 150 or less and a triol having a molecular weight of 150 or less. The urethane composition according to the second embodiment differs from the urethane composition according to the first embodiment in that a diol having a molecular weight of 150 or less is further included for the crosslinker or the chain extender. Since the other components (polyol, isocyanate, other components, and the like) and contents thereof are the same as in the urethane composition according to the first embodiment, descriptions thereof will be omitted.

In the urethane composition according to the second embodiment, when a content of the isocyanate is relatively large, a linear polyurethane has a higher amount of aggregation in hard segments comprising a urethane bond (polar group) and becomes hard, and is likely to become fragile and warped. Here, when the crosslinker or the chain extender is added thereto, it becomes harder. However, since the crosslinker or the chain extender contains a trifunctional triol, an effect of preventing crystallization according to crosslinking is exhibited, and thus it is possible to prevent warping (reduce warping).

In the urethane composition according to the second embodiment, a content of a triol of the crosslinker or the chain extender is 0.8 mass % or more with respect to the entire composition. Therefore, even if a content of the isocyanate is relatively large, it is possible to prevent warping while high hardness is maintained, and toner scraping properties after severe use are adequate while the initial toner scraping properties are maintained. In this regard, a content of a triol of the crosslinker or the chain extender is preferably 1.0 mass % or more and more preferably 1.5 mass % or more with respect to the entire composition.

On the other hand, when a content of the crosslinker or the chain extender is excessively large, a part of the crosslinker or the chain extender is also a hard segment, hard segments including the crosslinker or the chain extender are likely to aggregate and crystallize and warping is likely to occur. Therefore, a content of the crosslinker or the chain extender is 4.0 mass % or less with respect to the entire composition. Therefore, aggregation and crystallization of hard segments including the crosslinker or the chain extender are prevented and thereby it is possible to prevent warping (reduce warping). In this regard, a content of the crosslinker or the chain extender is preferably 3.5 mass % or less and more preferably 3.0 mass % or less with respect to the entire composition.

In the urethane composition according to the second embodiment, as the crosslinker or the chain extender, a diol may be contained in addition to the triol. When a content of the diol is large, the hardness increases. On the other hand, warping is likely to occur. In addition, when a content of the diol decreases, the hardness decreases. Therefore, in consideration of each of properties such as hardness and warping, proportions of a triol and a diol may be adjusted.

In order to prevent warping, a proportion of a triol in the crosslinker or the chain extender is preferably 20 mass % or more, more preferably 30 mass % or more, still more preferably 40 mass % or more, and most preferably 50 mass % or more with respect to the entire crosslinker or chain extender. In addition, in order to further increase the hardness while preventing warping, a proportion of a triol in the crosslinker or the chain extender is preferably 60 mass % or more and more preferably 70 mass % or more with respect to the entire crosslinker or chain extender. On the other hand, in order to shift a peak temperature of tan δ which is an index representing rubber elasticity of a urethane rubber to a low temperature, prevent the rubber elasticity from decreasing at lower temperatures, and ensure low temperature properties, a content of the diol should be within a predetermined range, and a proportion of a triol in the crosslinker or the chain extender is preferably 95 mass % or less, more preferably 90 mass % or less, and most preferably 80 mass % or less with respect to the entire crosslinker or chain extender.

As a diol of the crosslinker or the chain extender, 1,4-butanediol (1,4-BD), ethylene glycol (EG), 1,6-hexanediol (1,6-HD), diethylene glycol (DEG), propylene glycol (PG), dipropylene glycol (DPG), 1,4-cyclohexanediol, 1,4-cyclohexanedimethanol, xylene glycol, and triethylene glycol may be exemplified. These may be used alone or two or more thereof may be used in combination. Among them, 1,4-butanediol is particularly preferable from a viewpoint of a strong effect of preventing crystallization or the like.

The present blade can be produced using the urethane composition according to a general method such as a prepolymer method, a semi-one-shot method, and a one shot method. For example, the present blade can be produced as follows. First, a polyol and an isocyanate are prepared, these are mixed at predetermined proportions (NCO %) and reacted under predetermined reaction conditions to prepare a urethane prepolymer (main agent solution). On the other hand, a polyol, a crosslinker or a chain extender, and a curing catalyst and the like as necessary are prepared, these are mixed at predetermined proportions, and mixed under predetermined conditions to prepare a curing agent solution. Next, a urethane composition obtained by combining and mixing the main agent solution and the curing agent solution at predetermined proportions so that a predetermined NCO index is obtained is injected into a mold for molding a cleaning blade to which a holding tool is attached and is reacted and cured. The obtained cured product of the urethane composition is removed from the mold for molding a cleaning blade and processed into a predetermined shape. Thereby, as shown in FIG. 1, the present blade including a blade part comprising the cured product of the urethane composition that is integrally molded with a holding part is obtained.

According to the present blade 10 having the above configuration, it is possible to obtain both high hardness and low warping, and realize excellent toner scraping properties. In the urethane composition according to the first embodiment, the crosslinker or the chain extender comprises only a triol, and contains no diol. On the other hand, in the urethane composition according to the second embodiment, the crosslinker or the chain extender comprises a triol and a diol, and contains a diol. When an amount of the crosslinker or the chain extender is the same, the first embodiment containing no diol has a superior effect of preventing warping and the second embodiment containing a diol has superior hardness.

In the present blade 10, in consideration of high hardness, a rubber hardness of the urethane rubber is preferably an IRHD of 80 or more and more preferably an IRHD of 85 or more. On the other hand, in order to reduce an effect such as scraping of a photosensitive drum which is a counterpart member, an IRHD of 95 or less is preferable. Regarding the rubber hardness, an international rubber hardness is measured according to JIS K 6253 using a Wallace micro hardness tester (commercially available from H. W. WALLACE) under measurement conditions of 25° C. and 50% RH according to an international rubber hardness test method M method. The rubber hardness can be adjusted to a desired value according to the type and composition of the urethane rubber. For example, when an amount of the isocyanate, or an amount of the crosslinker or chain extender is increased, the hardness can be increased.

In the present blade 10, warping properties of the urethane rubber can be estimated from an amount of warping. The amount of warping can be calculated from an amount of deformation when displacement is caused under predetermined conditions and deformation is then released and a predetermined time has passed. A proportion of the amount of warping with respect to the amount of displacement is preferably 10% or less, more preferably 9% or less, and most preferably 8% or less.

In the present blade 10, in order to prevent chipping during cleaning, the elongation at break of the urethane rubber is preferably 170% or more and more preferably 180% or more. The elongation at break can be measured according to JIS K6400-5. The elongation at break can be adjusted to a desired value according to the type and composition of the urethane rubber. For example, when an amount of the isocyanate or an amount of the crosslinker or the chain extender is decreased, the elongation at break can be improved.

EXAMPLES

While the disclosure will be described below in detail with reference to examples, the disclosure is not limited to the following configurations.

Details of materials used are as follows.

<Polyol (a)>

PBA (polybutylene adipate): "Nipporan 4010" commercially available from Nippon Polyurethane Industry Co., Ltd., number average molecular weight Mn=2,000

PEA/BA (ethylene adipate/butylene adipate copolymer): "Nipporan 4042" commercially available from Nippon Polyurethane Industry Co., Ltd., number average molecular weight Mn=2,000

<Isocyanate (b)>

MDI(4,4'-diphenylmethane diisocyanate): "Millionate MT" commercially available from Nippon Polyurethane Industry Co., Ltd.

<Crosslinking Agent or Chain Extender (c)>

(c1: triol)

TMP (trimethylolpropane): commercially available from Mitsubishi Gas Chemical Company, Inc.

Glycerin: commercially available from Kishida Chemical Co., Ltd.

(c2: diol)

1,4BD (1,4-butanediol): commercially available from Mitsubishi Chemical Corporation EG (ethylene glycol): commercially available from Mitsubishi Chemical Corporation <Curing Catalyst>

TEDA (triethylenediamine): commercially available from Tosoh Corporation

Metal catalyst: K-KAT XK-627 (non-tin based urethane curing catalyst): commercially available from Kusumoto Chemicals, Ltd.

TAC: quaternary ammonium salt, commercially available from Sankyo Air Products

Examples 1 to 16, and Comparative Examples 1 to 7

<Preparation of Urethane Composition>

A polyol and a polyisocyanate were mixed and reacted under $N_2$ purging at 80° C. for 180 minutes to prepare a main agent (NCO-terminated urethane prepolymer). Next, the polyol, a crosslinker or a chain extender, and a curing catalyst were mixed to prepare a curing agent. Next, under a vacuum atmosphere, the main agent (urethane prepolymer) and the curing agent were mixed at 60° C. for 1 minute and sufficiently defoamed. Thereby, a urethane composition was prepared. Tables 1 to 3 show formulation amounts (mass % with respect to the entire composition) of the polyol, the isocyanate, and the crosslinker or the chain extender.

<Production of Cleaning Blade>

A plate-like holding tool was disposed in a forming mold for a cleaning blade, the urethane composition was injected into the forming mold, the forming mold was heated at 130° C., the urethane composition was cured, the mold was removed and thereby a cleaning blade was produced.

Physical properties such as the rubber hardness, the warping properties, and the elongation at break of each produced cleaning blade were calculated. In addition, the toner scraping properties (initial stage and after severe use) were evaluated. The measurement and evaluation results are shown in Tables 1 and 2.

(Rubber Hardness)

An international rubber hardness was measured according to JIS K 6253 using a Wallace micro hardness tester (commercially available from H. W. WALLACE) under measurement conditions of 25° C. and 50% RH according to an international rubber hardness test method M method.

(Warping Properties)

A tip part of a cleaning blade that was displaced 2.0 mm at an abutment angle of 25° was left in an environment of 45° C. and 90% for 5 days. After the displacement was released in a normal temperature and normal humidity environment, an amount of deformation after 1 hour was measured, and an amount of warping (%) was calculated from the following computational formula.

$$\text{Amount of warping (\%)} = (\text{amount of displacement}/2.0) \times 100$$

(Elongation at Break)

The elongation at break was measured according to JIS K6400-5.

(Toner Scraping Properties: Initial Stage)

Each of the cleaning blades were incorporated into a cartridge of a commercially available laser printer (Color LaserJet Enterprise M553), in an environment of 32.5° C.×85% RH, 50 solid images of an A4 size were output, and the initial toner scraping properties was evaluated. When there were no streak-like defects due to slip-through, this was determined as very good "A." When slight streaks were observed but they were within an allowable range, this was determined as good "B." When there were defects and they were beyond an allowable range, this was determined as poor "C."

(Toner Scraping Properties: After Severe Use)

Output (image: horizontal line image with 5% density) was performed. After 5,000 images were printed, a halftone image was printed and the image was checked. When there were no streak-like defects due to slip-through, this was determined as very good "A." When slight streaks were observed but they were within an allowable range, this was determined as good "B." When there were defects and they were beyond an allowable range, this was determined as poor "C."

TABLE 1

| | | Examples | | | | | | |
|---|---|---|---|---|---|---|---|---|
| | | 1 | 2 | 3 | 4 | 5 | 6 | 7 |
| a | PBA | 62.97 | 69.97 | 57.97 | 64.17 | 60.97 | — | 62.97 |
| | PEA/BA | — | — | — | — | — | 62.97 | — |
| b | MDI | 35 | 28 | 40 | 35 | 35 | 35 | 35 |
| c1 | TMP | 2 | 2 | 2 | 0.8 | 4 | 2 | — |
| | Glycerin | — | — | — | — | — | — | 2 |
| c2 | 1,4BD | — | — | — | — | — | — | — |
| | EG | — | — | — | — | — | — | — |
| Catalyst | TEDA | 0.01 | 0.01 | 0.01 | 0.01 | 0.01 | 0.01 | 0.01 |
| | K-KAT | 0.02 | 0.02 | 0.02 | 0.02 | 0.02 | 0.02 | 0.02 |
| | TAC | — | — | — | — | — | — | — |
| Physical properties | Rubber hardness (IRHD) | 85 | 80 | 90 | 83 | 88 | 86 | 86 |
| | Warping properties (%) | 7 | 3 | 8 | 5 | 8 | 7 | 7 |
| | Elongation at break (%) | 173 | 195 | 171 | 185 | 168 | 172 | 173 |
| Product properties | Toner scraping properties (initial stage) | A | B | A | B | A | A | A |
| | Toner scraping properties (after severe use) | A | B | B | B | B | A | A |

TABLE 2

| | | Examples | | | | | | | | |
|---|---|---|---|---|---|---|---|---|---|---|
| | | 8 | 9 | 10 | 11 | 12 | 13 | 14 | 15 | 16 |
| a | PBA | 61.97 | 68.97 | 56.97 | 62.97 | 60.97 | 60.97 | — | 61.97 | 61.97 |
| | PEA/BA | — | — | — | — | — | — | 61.97 | — | — |
| b | MDI | 35 | 28 | 40 | 35 | 35 | 35 | 35 | 35 | 35 |
| c1 | TMP | 2 | 2 | 2 | 0.8 | 2 | 0.8 | 2 | — | 2 |
| | Glycerin | — | — | — | — | — | — | — | 2 | — |
| c2 | 1,4BD | 1 | 1 | 1 | 1.2 | 2 | 3.2 | 1 | 1 | — |
| | EG | — | — | — | — | — | — | — | — | 1 |
| Catalyst | TEDA | 0.01 | 0.01 | 0.01 | 0.01 | 0.01 | 0.01 | 0.01 | 0.01 | 0.01 |
| | K-KAT | 0.02 | 0.02 | 0.02 | 0.02 | 0.02 | 0.02 | 0.02 | 0.02 | 0.02 |
| | TAC | — | — | — | — | — | — | — | — | — |
| Physical properties | Rubber hardness (IRHD) | 86 | 81 | 91 | 86 | 92 | 91 | 87 | 87 | 87 |
| | Warping properties (%) | 8 | 5 | 9 | 9 | 9 | 10 | 8 | 8 | 9 |
| | Elongation at break %) | 172 | 190 | 171 | 176 | 170 | 172 | 174 | 172 | 171 |
| Product properties | Toner scraping properties (initial stage) | A | B | A | A | A | A | A | A | A |
| | Toner scraping properties (after severe use) | B | B | B | B | B | B | B | B | B |

TABLE 3

| | | Comparative Examples | | | | | | |
|---|---|---|---|---|---|---|---|---|
| | | 1 | 2 | 3 | 4 | 5 | 6 | 7 |
| a | PBA | 70.97 | 59.97 | 59.97 | 69.97 | 65.28 | 67.55 | 68.96 |
| | PEA/BA | — | — | — | — | — | — | — |
| b | MDI | 27 | 35 | 35 | 27 | 30 | 27.9 | 25.6 |
| c1 | TMP | 2 | 5 | 2 | 2 | 1.9 | 1.8 | 3.81 |
| | Glycerin | — | — | — | — | — | — | — |
| c2 | 1.4BD | — | — | 3 | 1 | 2.8 | 2.73 | 1.61 |
| | EG | — | — | — | — | — | — | — |
| Catalyst | TEDA | 0.01 | 0.01 | 0.01 | 0.01 | 0.01 | 0.01 | 0.02 |
| | K-KAT | 0.02 | 0.02 | 0.02 | 0.02 | — | — | — |
| | TAC | — | — | — | — | 0.01 | 0.01 | — |
| Physical properties | Rubber hardness (IRHD) | 78 | 90 | 88 | 79 | 84 | 80 | 78 |
| | Warping properties (%) | 4 | 12 | 14 | 6 | 11 | 11 | 5 |
| | Elongation at break (%) | 198 | 160 | 164 | 187 | 165 | 167 | 185 |
| Product properties | Toner scraping properties (initial stage) | C | A | A | C | B | C | C |
| | Toner scraping properties (after severe use) | C | C | C | C | C | C | C |

The urethane compositions of Examples 1 to 7 contained a polyol, an isocyanate, and a crosslinker or a chain extender. The crosslinker or the chain extender comprised a triol having a molecular weight of 150 or less. With respect to the entire composition, a content of the isocyanate was 28.0 mass % or more, a content of the crosslinker or the chain extender was 4.0 mass % or less, and a content of the triol was 0.8 mass % or more. According to Examples 1 to 7, the rubber hardness was 80 or more in IRHD and the hardness was high, and the warping properties were 10% or less and the warping was low. In addition, the elongation at break was 170% or more and the elongation was high. Thus, excellent toner scraping properties were exhibited both at the initial stage and after severe use. On the other hand, in the urethane composition of Comparative Example 1, a content of the isocyanate was less than 28.0 mass % and the rubber hardness was low. Thereby, the initial toner scraping properties were poor. In the urethane composition of Comparative Example 2, a content of the crosslinker or the chain extender (triol) exceeded 4.0 mass % and the warping properties were poor. In addition, the elongation at break was also poor. Thereby, the toner scraping properties after severe use were poor.

The urethane compositions of Examples 8 to 16 contained a polyol, an isocyanate, and a crosslinker or a chain extender. The crosslinker or the chain extender comprised a diol having a molecular weight of 150 or less and a triol having a molecular weight of 150 or less. With respect to the entire composition, a content of the isocyanate was 28.0 mass % or more, a content of the crosslinker or the chain extender was 4.0 mass % or less, and a content of the triol was 0.8 mass % or more. According to Examples 8 to 16, the rubber hardness was 80 or more in IRHD and the hardness was high, and the warping properties were 10% or less and the warping was low. In addition, the elongation at break was 170% or more and the elongation was high. Thus, excellent toner scraping properties were exhibited both at the initial stage and after severe use. On the other hand, in the urethane composition of Comparative Example 4, a content of the isocyanate was less than 28.0 mass % and the rubber hardness was low. Thereby, the initial toner scraping properties were poor. In the urethane composition of Comparative Example 3, a content of the crosslinker or the chain extender (diol and triol) exceeded 4.0 mass %, and the warping properties were poor. In addition, the elongation at break was also poor. Thereby, the toner scraping properties after severe use were poor.

The urethane composition of Comparative Example 5 was prepared according to the formulation in Patent Literature 1, a content of the crosslinker or the chain extender (diol and triol) exceeded 4.0 mass % and the warping properties were poor. In addition, the elongation at break was also poor. Thereby, the toner scraping properties after severe use were poor. The urethane composition of Comparative Example 6 was prepared according to the formulation in Patent Literature 1, a content of the isocyanate was less than 28.0 mass % and the rubber hardness was low. Thereby, the initial toner scraping properties were poor. In addition, a content of the crosslinker or the chain extender (diol and triol) exceeded 4.0 mass % and the warping properties were poor. In addition, the elongation at break was also poor. Thereby, the toner scraping properties after severe use were poor. The urethane composition of Comparative Example 7 was prepared according to the formulation in Patent Literature 2, a content of the isocyanate was less than 28.0 mass %, and the rubber hardness was low. Thereby, the initial toner scraping properties were poor. In addition, a content of the crosslinker or the chain extender (diol and triol) exceeded 4.0 mass % and the warping properties were poor. In addition, the elongation at break was also poor. Thereby, the toner scraping properties after severe use were poor.

While the embodiments of the disclosure have been described above in detail, the disclosure is not limited to the examples, and various modifications can be made without departing from the spirit of the disclosure.

What is claimed is:

1. A cleaning blade for electrophotographic equipment comprising a blade part comprising a cured material of a urethane composition containing a polyol, an isocyanate, and a crosslinker or a chain extender, wherein a content of the isocyanate is 28.0 mass % or more with respect to the entire composition, wherein the crosslinker or the chain extender comprises a triol having a molecular weight of 150 or less, wherein a content of the crosslinker or the chain extender is 4.0 mass % or less with respect to the entire composition, and wherein a content of the triol having a molecular weight of 150 or less is 0.8 mass % or more with respect to the entire composition.

2. The cleaning blade for electrophotographic equipment according to claim 1, wherein the crosslinker or the chain extender further comprises a diol having a molecular weight of 150 or less.

3. The cleaning blade for electrophotographic equipment according to claim 1, wherein the crosslinker or the chain extender comprises the triol having a molecular weight of 150 or less and contains no diol.

4. The cleaning blade for electrophotographic equipment according to claim 1, wherein the triol having a molecular weight of 150 or less is trimethylolpropane.

5. The cleaning blade for electrophotographic equipment according to claim 2, wherein the diol having a molecular weight of 150 or less is 1,4-butanediol.

6. The cleaning blade for electrophotographic equipment according to claim 1, wherein the content of the triol having a molecular weight of 150 or less is 2.0 mass % or more with respect to the entire composition.

7. The cleaning blade for electrophotographic equipment according to claim 2, wherein the triol having a molecular weight of 150 or less is trimethylolpropane.

8. The cleaning blade for electrophotographic equipment according to claim 7, wherein the diol having a molecular weight of 150 or less is 1,4-butanediol.

9. The cleaning blade for electrophotographic equipment according to claim 8, wherein the content of the triol having a molecular weight of 150 or less is 2.0 mass % or more with respect to the entire composition.

10. The cleaning blade for electrophotographic equipment according to claim 3, wherein the triol having a molecular weight of 150 or less is trimethylolpropane.

11. The cleaning blade for electrophotographic equipment according to claim 10, wherein the content of the triol having a molecular weight of 150 or less is 2.0 mass % or more with respect to the entire composition.

12. The cleaning blade for electrophotographic equipment according to claim 5, wherein the content of the triol having a molecular weight of 150 or less is 2.0 mass % or more with respect to the entire composition.

* * * * *